US006158127A

United States Patent [19]

Taylor

[11] Patent Number: 6,158,127

[45] Date of Patent: Dec. 12, 2000

[54] FOLDING KNIFE WITH ONE-HANDED BLADE MOVEMENT

[75] Inventor: William J. Taylor, Marietta, Ga.

[73] Assignee: Camillus Cutlery Co., Camillus, N.Y.

[21] Appl. No.: 09/227,377

[22] Filed: Jan. 8, 1999

[51] Int. Cl.[7] ..... B26B 1/02

[52] U.S. Cl. ..... 30/158

[58] Field of Search ..... 30/158, 159, 160, 30/161

[56] References Cited

U.S. PATENT DOCUMENTS

| | | | |
|---|---|---|---|
| 338,853 | 3/1886 | Marks | 30/161 X |
| 1,495,449 | 5/1924 | Sibley et al. | 30/160 X |
| 2,304,601 | 12/1942 | Schrade | 30/159 |
| 4,670,984 | 6/1987 | Rickard | 30/161 |
| 4,811,486 | 3/1989 | Cunningham | 30/158 X |
| 4,974,323 | 12/1990 | Cassady | 30/158 X |
| 5,060,379 | 10/1991 | Neely | 30/161 |
| 5,293,690 | 3/1994 | Cassady | 30/160 X |
| 5,495,674 | 3/1996 | Taylor, Jr. | 30/160 |
| 5,979,065 | 11/1999 | Hsu | 30/161 X |

FOREIGN PATENT DOCUMENTS

| | | | |
|---|---|---|---|
| 342119 | 10/1921 | Germany | 30/160 |
| 140515 | 3/1920 | United Kingdom | 30/160 |
| 246742 | 2/1926 | United Kingdom | 30/161 |

*Primary Examiner*—Rinaldi I. Rada
*Assistant Examiner*—Charles Goodman
*Attorney, Agent, or Firm*—George R. McGuire; Hancock & Estabrook, LLP

[57] ABSTRACT

A folding knife of the type wherein the blade may be moved between open and closed positions with the hand holding the knife. A blade is connected by a fixed pivot pin to a casing having the usual two handle or cover pieces providing a casing with a space for receiving the blade in the closed position. A substantially V-shaped slot extends through one of the cover pieces in close proximity and partially surrounding relation to the pivot pin. In addition to a circular opening for the pivot pin, the blade tang includes a linearly elongated, through slot communicating at one end with the circular opening. An actuating member, having integral head and stem portions, extends through the V-shaped slot in the cover piece and slidingly engages the slot in the blade tang, and into a blind V-slot in the inwardly facing surface of the other cover piece. The head of the actuating member may be manually engaged by the operator and moved from one end of the V-shaped slot to the other as the stem portion engaging the tang slot moves the blade about the pivot pin between open and closed positions.

10 Claims, 2 Drawing Sheets

30
14
16a
36b
10
12

1a
22
32
34
16a
30c
36b
28
10
18
16
12
18

2a
28
36b
30
30c
16a
22
32
34
10
12
16
18

36
36b
36a
12
30
30b
36a'
14

22
34
12
28
16
14
26
30a
32

FOLDING KNIFE WITH ONE-HANDED BLADE MOVEMENT

BACKGROUND OF THE INVENTION

The present invention relates to folding knives, and more particularly to knives having a blade or other implement movable between open and closed positions with one hand, i.e., the hand holding the knife.

Folding knives, also known as pocket knives, include one or more blades or other implements which are movable about a pivot axis between open and closed positions relative to a casing in the form of a handle portion of the knife. In most folding knife designs, the casing is held in one hand while the blade or implement is moved with the other hand. In some designs, such as so-called switch blades, a spring biases the blade, and effects movement thereof, to the -1S open position in response to manual manipulation of a release mechanism, normally by the hand holding the knife. Other examples of folding knife designs wherein blade movement is effected by the hand holding the knife may be found in applicant's U.S. Pat. Nos. 4,719,700 and 5,495,674.

The object of the present invention is to provide a novel and improved folding knife wherein the blade or other implement may be moved between open and closed positions with respect to the casing by manipulation performed with the hand holding the knife.

SUMMARY OF THE INVENTION

The knife of the invention is disclosed in an embodiment including a handle portion or casing made up of a pair of cover pieces and a spacer. The spacer, which is smaller than the cover pieces, is placed between the opposed, inwardly facing surfaces of the cover pieces to provide therebetween a space of suitable dimensions for receiving at least a portion of the blade or other implement when in the folded or closed position. The blade, which term will be used herein as inclusive of any implement which may be mounted upon and pivotally moved with respect to a knife casing, is attached to the casing with a pivot pin extending through an opening in the tang portion of the blade and anchored to the casing on opposite sides of the blade. The cover pieces and spacer are fixedly attached to one another with an unattached end portion of the spacer acting as a spring bearing on the tang portion of the blade and as a stop defining the fully open position of the blade.

All features generally described in the preceding paragraph are conventional in prior art folding knife designs. Features unique to the design of the present invention include a through, linearly elongated slot in the blade tang communicating at one end with the pivot pin opening, a generally V-shaped slot extending through the cover piece on one side of the casing and a matching slot extending into the inwardly facing surface and partially through the cover piece on the other side of the casing. The slots are closely adjacent to and partially surround the pivot axis. An actuating member having a stem portion and a head portion is placed with the stem extending through the open V-slot in one cover piece, through the open slot in the blade tang, and into the blind slot in the other cover piece, with the head portion on the outer surface of the cover piece with the through slot. The operator may engage the head of the actuating member with the thumb of the hand holding the casing and push the actuating member from one end of the V-shaped slot to the other. During such movement, the blade is moved, by the stem portion of the actuating member engaging the sides of the open slot in the blade tang, from the closed to the open position. Opposite movement of the button effects closing movement of the blade.

The foregoing and other features of construction and operation of the folding knife of the invention will be more readily understood and fully appreciated from the following detailed description, taken in conjunction with the accompanying drawings.

DETAILED DESCRIPTION

Figures 1, 1A, 2, 2A, 3:
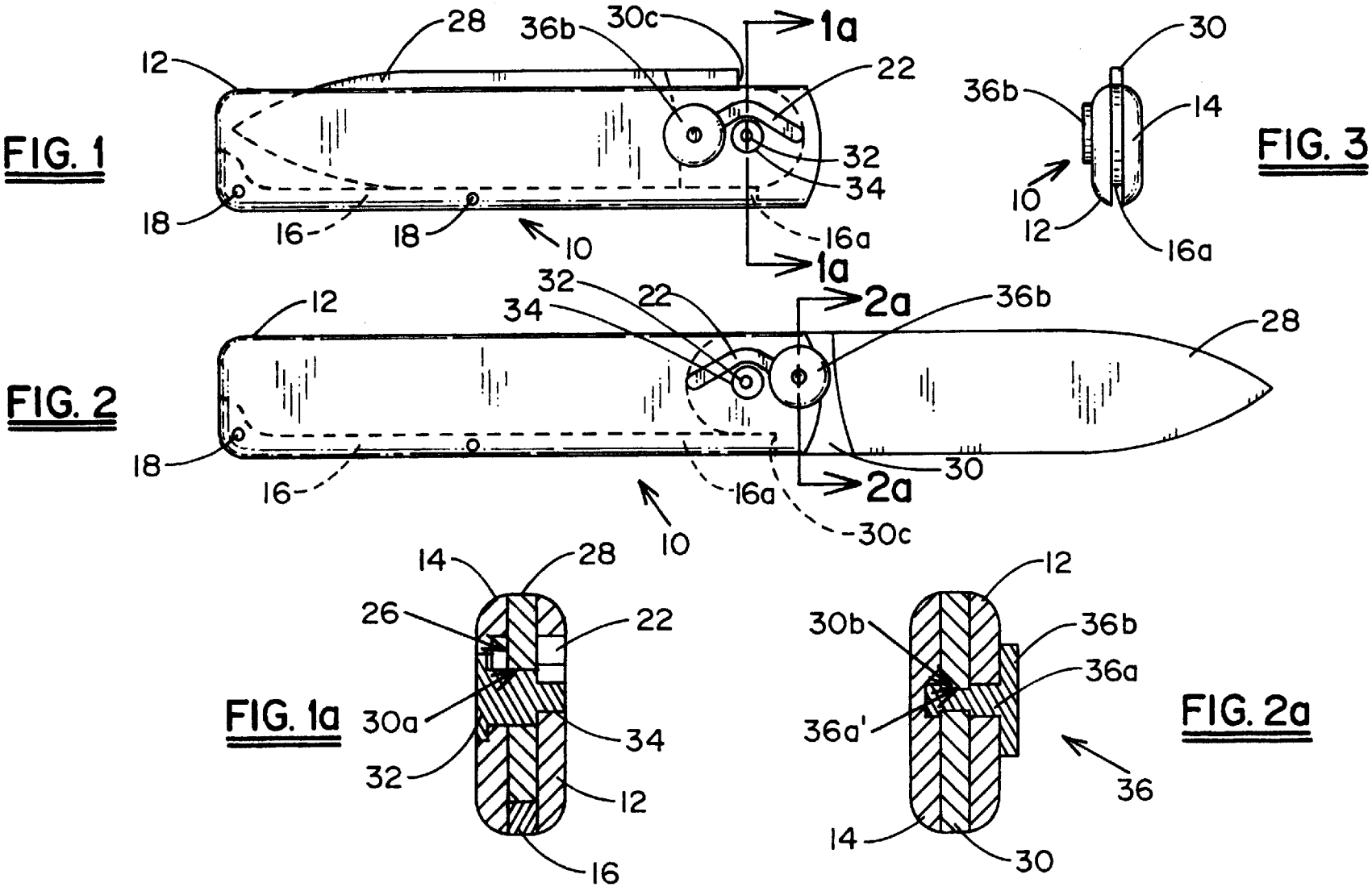
FIGS. 1 and 2 are side elevational views of the disclosed embodiment of the knife in the closed and open positions, respectively.
FIGS 1A and 2A are elevational views in section on the line 1A—1A of FIG. 1, and 2A—2A of FIG. 2, respectively.
FIG. 3 is a front elevational view of the knife in the closed position.
Figure 4A:
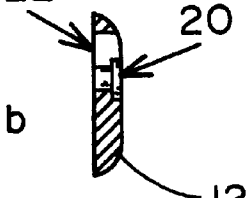
FIGS. 4A and 5A are elevational views in section on the line 4A—4A of FIG. 4, and 5A—5A of FIG. 5, respectively.

The knife of the invention, denoted generally by reference numeral 10, includes a handle portion or casing made up, in the disclosed embodiment, of cover pieces or wall members 12 and 14 and spacer 16. Cover pieces 12 and 14 are of identical outline and are placed in superposed relation with spacer 16 between the opposed, inwardly facing surfaces of the cover pieces along portions of one, elongated side and one end, as seen in hidden lines in FIGS. 1 and 2. The three casing pieces are fixedly attached by rivets 18, leaving end portion 16*a* free for limited movement in the manner of a cantilever spring.

Figure 5A:
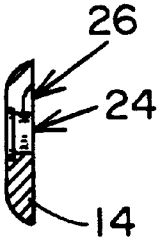
Figure 4:
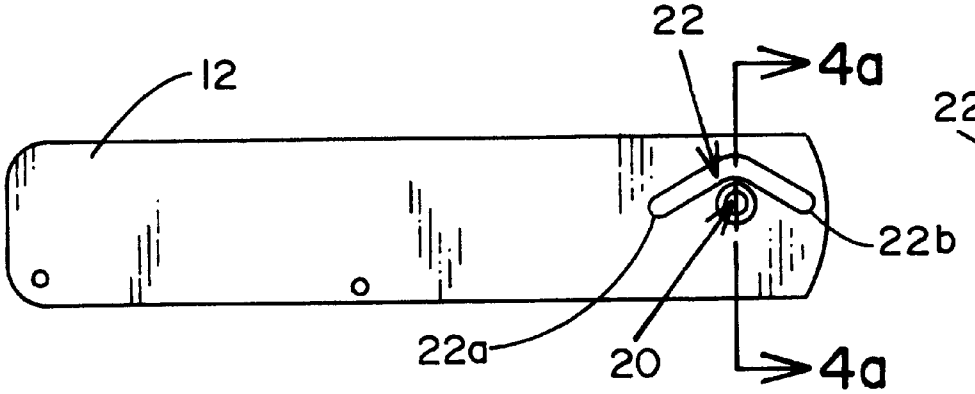
FIGS. 4 and 5 side elevational views of the two cover pieces of the knife casing, seen from the outwardly and inwardly facing sides, respectively.
Figure 5:
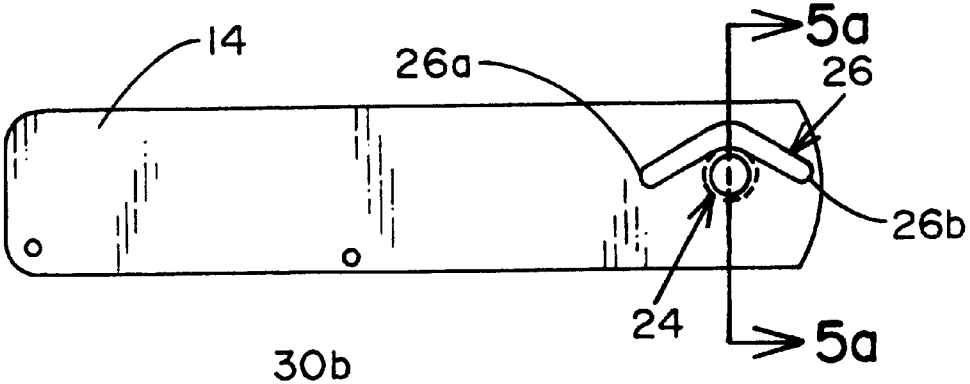

Cover pieces 12 and 14 are shown individually in FIGS. 4 and 5, respectively. The surface of cover piece 12 seen in FIG. 4 is the surface which faces outwardly in the assembled condition of the knife, while the surface seen in FIG. 5 is the inwardly facing surface. Cover piece 12 includes through, circular opening 20, having relatively larger and smaller diameter portions, and through slot 22, extending in essentially V-shaped configuration between opposite ends 22*a* and 22*b*. Cover piece 14 includes through, circular opening 24, also having relatively larger and smaller diameter portions, and V-shaped slot 26 extending into the inwardly facing surface, but only partially through cover piece 14, as seen in FIG. 5A. (V-shaped slot 26 includes opposite ends 26*a* and 26*b*) Thus, slot 22 is termed an open slot and slot 26 a blind slot.

Blade 28 has tang portion 30 at one end. Circular opening 30*a* and linearly elongated slot 30*b*, communicating at one end with opening 30*a*, extend through tang 30. Blade 28 is attached to the casing by pivot pin 32 for movement between the folded position of FIG. 1, wherein the cutting edge, pointed end, and majority of blade 28 is received in the space between the opposed surfaces of cover pieces 12 and 14, and the open position of FIG. 2. As best seen in FIG. 1A, pivot pin 32 extends through opening 24 of cover piece 14, opening 30*a* of blade 28 and opening 20 of cover piece 12, and is secured by washer 34.

Actuating member 36 includes integral stem and head portions 36*a* and 36*b*, respectively. The parts are assembled by inserting stem portion 36*a* through open slot 22 of cover piece 12 and through circular opening 30*a* of tang 30. Reduced diameter portion 36*a*' of stem portion 36*a* is then slid into tang slot 30*b*, the axial length of reduced diameter portion 36*a*' being approximately equal to the thickness of tang 30. The terminal end portion of stem 36*a* is placed in slot 26, the cover pieces, blade and actuating member then being in the relative positions shown in FIG. 2A. Pivot pin 32 is then inserted and secured, and the cover pieces and spacer 16 are mutually attached by rivets 18 to complete assembly of knife 10. In moving blade 28 from the closed to the open position, the periphery of tang 30 flexes end portion 16*a* of spacer 16 downwardly, as seen in FIGS. 1 and 2, and the end portion engages shoulder 30*c* of the tang to define the fully open position of the blade, as in conventional folding knives. It will be noted that the distance between stem portion 36*a* and pivot pin 32 varies as actuating member 36 is moved from one end of the V-shaped slots to the other. This is accommodated by reduced diameter portion 36*a*' moving longitudinally along tang slot 30*b* during movement of the actuating member.

Figure 6:
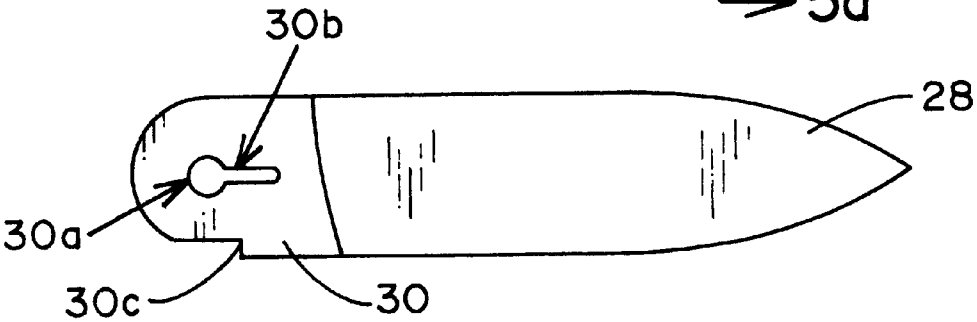
FIG. 6 is a side elevational view of the blade.

Contemplated modifications include changing the position of the cover piece slots relative to the pivot pin, which would also involve changing the orientation of the tang slot. For example, if the cover piece slots were to be placed below the pivot pin, as the knife is oriented in FIGS. 1 and 2, slot 30*b* would extend from opening 30*a* toward the left, as the blade is oriented in FIG. 6. Configurations of other than V-shaped for the cover piece slots, and other than linear for the tang slot are also possible, although the illustrated configurations are preferred. The invention may also be employed in a two-bladed knife with through slots in both cover pieces and corresponding slots in a wall member between the blades.

What is claimed is:

1. A folding knife comprising:

a) a casing extending along a longitudinal axis and including a pair of spaced wall members through at least one of which a first slot is formed;

b) a blade having proximal and distal ends, a tang portion adjacent said proximal end, a pivot pin receiving opening formed through said tang portion, and a second slot formed through said tang portion;

c) a pivot pin extending through said pivot receiving opening and anchored in said wall members to establish a pivot axis, perpendicular to said longitudinal axis and fixed with respect to said casing, about which said blade is movable between open and closed positions with respect to said casing; and d) an actuating member having a manually engageable portion positioned on an exterior of said casing and a stem portion extending from said manually engagable portion, said stem portion extending through and positioned for sliding movement relative to said first elongated slot in said casing and said second elongated slot, whereby said blade movement is actuated between said open and closed positions in response to manual movement of said actuating member along said first and second slots and between first and second positions relative thereto.

2. The knife of claim 1 wherein said stem portion extends along a linear axis parallel to and spaced from said pivot axis.

3. The knife of claim 2 wherein said first slot is substantially V-shaped.

4. The knife of claim 3 wherein said first slot partially surrounds said pivot pin.

5. The knife of claim 1 wherein said first slot extends along a non-linear path between said first and second positions.

6. The knife of claim 5 wherein said first slot has first and second, opposite ends and said first and second positions are substantially at said opposite ends.

7. The knife of claim 6 wherein said manually engagable portion comprises a head portion integral with said stem portion.

8. The knife of claim 1 wherein said first slot extends fully through one of said wall members and a third slot extends partially through the other of said wall members.

9. The knife of claim 8 wherein said stem portion extends fully through said first slot in said one of said wall members to a terminal end within the said third slot in said other of said wall members and includes a medial portion engaging said blade.

10. The invention according to claim 1, wherein said second slot and said pivot pin receiving opening are positioned in communication with one another.

* * * * *